US009733596B1

(12) United States Patent
Furukawa et al.

(10) Patent No.: US 9,733,596 B1
(45) Date of Patent: Aug. 15, 2017

(54) CONDUCTIVE MEMBER FOR IMAGE-FORMING APPARATUS, TRANSFER UNIT FOR IMAGE-FORMING APPARATUS, AND IMAGE-FORMING APPARATUS

(71) Applicant: FUJI XEROX CO., LTD., Tokyo (JP)

(72) Inventors: Masato Furukawa, Kanagawa (JP); Tomoko Suzuki, Kanagawa (JP); Takahiko Yamazaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/251,019

(22) Filed: Aug. 30, 2016

(30) Foreign Application Priority Data

Mar. 28, 2016 (JP) ..... 2016-064700

(51) Int. Cl.
*G03G 15/16* (2006.01)

(52) U.S. Cl.
CPC ..... *G03G 15/162* (2013.01)

(58) Field of Classification Search
CPC ..... G03G 15/162; G03G 2215/1623
USPC ..... 399/297, 302, 308, 313; 430/125.32
See application file for complete search history.

(56) References Cited

U.S. PATENT DOCUMENTS

2004/0105983 A1* 6/2004 Hattori ..... B29C 47/0021 428/421
2015/0205228 A1* 7/2015 Ichizawa ..... G03G 15/162 399/308

FOREIGN PATENT DOCUMENTS

JP 2002-003651 A 1/2002
JP 2007-241307 A 9/2007

* cited by examiner

*Primary Examiner* — Sandra Brase
(74) *Attorney, Agent, or Firm* — Sughrue Mion, PLLC

(57) ABSTRACT

A conductive member for an image-forming apparatus includes a conductive layer including a matrix containing a conductive organic polymer material and domains formed by aggregate particles of an electronically conductive conductivity-imparting agent and having sizes of about 100 nm to about 3 μm. About 20 to about 50 domains are present in a 10 μm×10 μm square in the conductive layer.

20 Claims, 7 Drawing Sheets

CONDUCTIVE MEMBER FOR IMAGE-FORMING APPARATUS, TRANSFER UNIT FOR IMAGE-FORMING APPARATUS, AND IMAGE-FORMING APPARATUS

CROSS-REFERENCE TO RELATED APPLICATIONS

This application is based on and claims priority under 35 USC 119 from Japanese Patent Application No. 2016-064700 filed Mar. 28, 2016.

BACKGROUND (i) Technical Field

The present invention relates to conductive members for image-forming apparatuses, transfer units for image-forming apparatuses, and image-forming apparatuses.

(ii) Related Art

Electrophotographic image-forming apparatuses include various conductive members such as charging rollers, transfer belts, recording medium transport belts, and transfer rollers.

SUMMARY

According to an aspect of the invention, there is provided a conductive member for an image-forming apparatus. The conductive member includes a conductive layer including a matrix containing a conductive organic polymer material and domains formed by aggregate particles of an electronically conductive conductivity-imparting agent and having sizes of about 100 nm to about 3 μm. About 20 to about 50 domains are present in a 10 μm×10 μm square in the conductive layer.

BRIEF DESCRIPTION OF THE DRAWINGS

Exemplary embodiments of the present invention will be described in detail based on the following figures, wherein.

DETAILED DESCRIPTION

Figure 1:
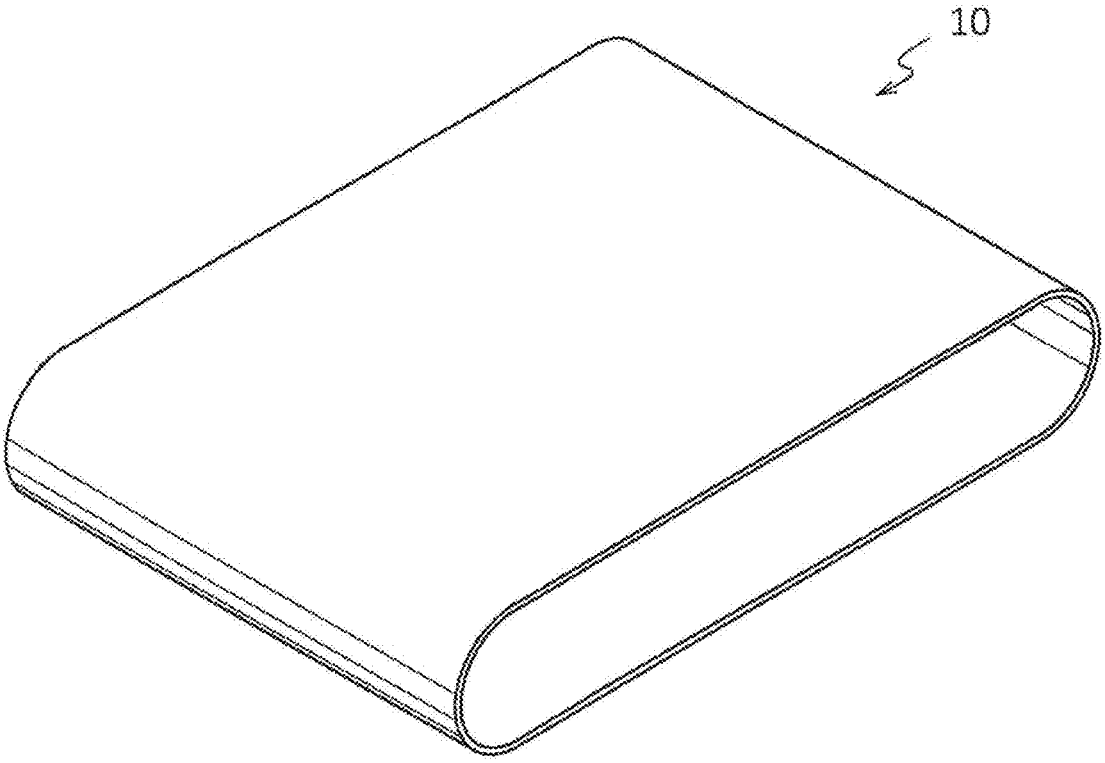
FIG. 1 is a schematic perspective view of an example conductive member for an image-forming apparatus according to an exemplary embodiment.

Exemplary embodiments of the present invention will now be described in detail with reference to the drawings.

Conductive Member

A conductive member for an image-forming apparatus according to an exemplary embodiment (hereinafter also referred to as "conductive member") includes a conductive layer containing a conductive organic polymer material and an electronically conductive conductivity-imparting agent. The conductive layer includes a matrix containing the conductive organic polymer material and domains formed by aggregate particles of the electronically conductive conductivity-imparting agent and having sizes of 100 nm to 3 μm or about 100 nm to about 3 μm. In the conductive layer, 20 to 50 or about 20 to about 50 domains are present in a 10 μm×10 μm square. As used herein, the term "conductive" refers to, for example, a volume resistivity of less than $1.0\times10^{9}\Omega\cdot m$.

The electrical resistance of the conductive member according to this exemplary embodiment may not substantially increase after a high voltage (e.g., 1.0 kV or more) is repeatedly applied. Although the mechanism is not fully understood, a possible explanation is given below.

When a toner image is transferred from a surface of an image carrier (hereinafter also referred to as "electrophotographic photoreceptor" or "photoreceptor") to an intermediate transfer belt (first transfer) and is then transferred from the intermediate transfer belt to a recording medium such as paper (second transfer), the recording medium is transported to a second transfer area where the second transfer is performed, for example, by a belt.

Examples of recording medium transport/transfer belts for transporting a recording medium to a transfer area (hereinafter also referred to as "transport/transfer belt" or "transfer belt") include resin belts made of polymer materials such as polyimides and elastic belts containing rubber components such as ethylene-propylene-diene terpolymer rubber (EPDM), chloroprene rubber (CR), acrylonitrile-butadiene copolymer rubber (NBR), and epichlorohydrin rubber (ECO). For example, elastic belts may be used to reduce belt meandering.

A transport/transfer belt having a higher resistance is required to avoid poor transfer at the edges of a sheet due to current leakage to the non-paper-feed area.

For example, the resistance of elastic belts made of ionically conductive elastic materials such as the rubber components mentioned above increases after a high voltage is repeatedly applied during continuous use. To reduce variations in image quality due to increased belt resistance, the voltage applied to transfer toner needs to be increased with increasing belt resistance. The use of a belt having a higher resistance at a higher voltage requires a power supply having a higher capacity and also tends to induce discharge.

Possible causes that increase the resistance of ionically conductive materials after a high voltage is repeatedly applied are ion segregation and oxidative degradation.

If an electronically conductive conductivity-imparting agent (hereinafter also referred to as "electronic conductor") is used as a conductor, hopping conduction occurs between conductive carriers such as the electronic conductor. In this case, the resistance decreases after dielectric breakdown occurs in the polymer material between the electronic conductor particles.

In contrast, 20 or more or about 20 or more domains formed by aggregate particles of an electronic conductor and having sizes of 100 nm to 3 μm or about 100 nm to about 3 μm are present in a 10 μm×10 μm square in the conductive layer of the conductive member according to this exemplary embodiment. This may reduce the concentration of current in the matrix, which contains a conductive polymer material, and may thus reduce the increase in resistance due to ion segregation and oxidative degradation. In addition, 50 or less or about 50 or less such domains are present in a 10 μm×10 μm square in the conductive layer. This may prevent an excessive current from flowing between the domains and may thus reduce the decrease in resistance due to dielectric breakdown in the polymer material between the domains. That is, both the increase in the resistance of the conductive polymer material and the decrease in resistance due to the presence of the electronic conductor may be reduced. Thus, the resistance of the conductive member according to this exemplary embodiment may not substantially increase after a high voltage is repeatedly applied.

The conductive member according to this exemplary embodiment may be of any shape, such as an endless belt, roller, or sheet. The conductive member according to this exemplary embodiment may include other layers in addition to the conductive layer. A conductive endless belt member (hereinafter also referred to as "conductive belt member") for use as a transport/transfer belt will now be described as an example of the conductive member according to this exemplary embodiment.

Figure 2:
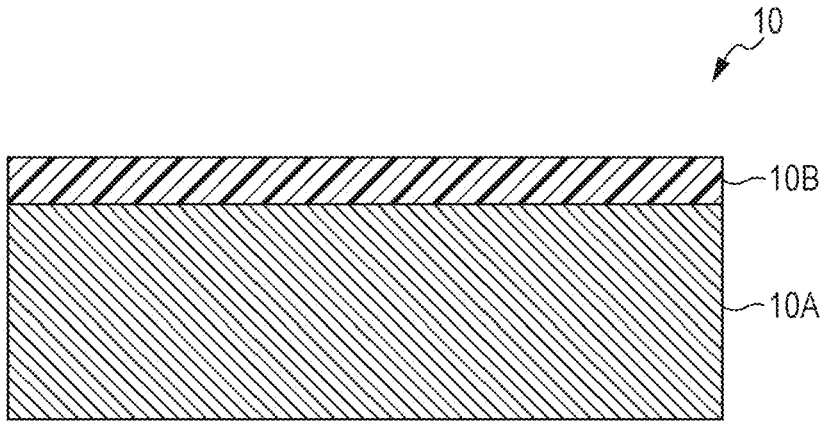
FIG. 2 is a schematic view of an example layer structure of the conductive member according to the exemplary embodiment.

FIG. 1 is a schematic perspective view of a conductive belt member serving as an example of the conductive member according to this exemplary embodiment. FIG. 2 is a schematic view of an example layer structure.

As shown in FIG. 1, a conductive belt member 10 for an image-forming apparatus includes a substrate layer 10A and a surface layer 10B disposed on the outer surface of the substrate layer 10A.

Substrate Layer

The substrate layer 10A is a conductive layer containing a conductive organic polymer material, an electronically conductive conductivity-imparting agent (hereinafter also referred to as "electronic conductor"), and optionally other known additives. The substrate layer 10A includes a matrix containing the conductive organic polymer material and domains formed by aggregate particles of the electronic conductor and having sizes of 100 nm to 3 μm or about 100 nm to about 3 μm. In the substrate layer 10A, 20 to 50 or about 20 to about 50 domains are present in a 10 μm×10 μm square.

Conductive Organic Polymer Material

The conductive organic polymer material forms the matrix of the substrate layer 10A. Examples of conductive organic polymer materials that may be present in the substrate layer 10A include conductive resin materials and rubber materials. If the conductive member according to this exemplary embodiment is used as a transport/transfer belt, a rubber material may be used for its elasticity as the conductive organic polymer material present in the substrate layer 10A.

Examples of rubber materials include isoprene rubber, chloroprene rubber (CR), epichlorohydrin rubber (ECO), butyl rubber, polyurethane, silicone rubber, fluoroelastomers, styrene-butadiene rubber, butadiene rubber, nitrile rubber, ethylene-propylene rubber, epichlorohydrin-ethylene oxide copolymer rubber, epichlorohydrin-ethylene oxide-allyl glycidyl ether copolymer rubber, ethylene-propylene-diene terpolymer rubber (EPDM), acrylonitrile-butadiene copolymer rubber (NBR), natural rubber, and blends thereof.

Preferred among these rubber materials are polar rubbers such as ECO, CR, and EPDM and blends thereof.

The rubber material is preferably present in the substrate layer 10A in an amount of 50% to 90% by mass, more preferably 70% to 85% by mass, even more preferably 75% to 80% by mass.

A rubber material containing EPDM, CR, ECO, and NBR as rubber components may be used as the conductive organic polymer material for reasons of electrical resistance control. These rubber components are preferably present in the following amounts by mass per 100% by mass of the rubber material:

EPDM: 20% to 45% by mass (more preferably 35% to 40% by mass)

CR: 20% to 40% by mass (more preferably 30% to 35% by mass)

ECO: 0% to 20% by mass (more preferably 10% to 15% by mass)

NBR: 0% to 15% by mass

Electronically Conductive Conductivity-Imparting Agent

Typical conductivity-imparting agents (conductors) include electronically conductive conductivity-imparting agents (electronic conductors) and ionically conductive conductivity-imparting agents (ionic conductors). The substrate layer 10A according to this exemplary embodiment contains an electronic conductor. The electronic conductor is present as aggregate particles that form the domains in the substrate layer 10A. In the substrate layer 10A, 20 to 50 or about 20 to about 50 domains formed by aggregate particles of the electronic conductor and having sizes of 100 nm to 3 μm or about 100 nm to about 3 μm are present in a 10 μm×10 μm square.

In this exemplary embodiment, the size of the domains formed by the aggregate particles of the electronic conductor refers to the maximum size of those domains. The size of the domains of the electronic conductor and the number of domains present in a 10 μm×10 μm square may be determined by examining a cross-sectional surface of the conductive member. The specific procedure is discussed later in the Examples.

To reduce the concentration of current in the matrix when a high voltage is applied while avoiding dielectric breakdown between the domains, it is preferred that 20 to 50 or about 20 to about 50 domains formed by aggregate particles of the electronic conductor and having sizes of 100 nm to 3 μm or about 100 nm to about 3 μm be present in a 10 μm×10 μm square. More preferably, 25 to 40 or about 25 to about 40 such domains are present in a 10 μm×10 μm square.

Although a certain number of domains having sizes of less than 100 nm may be present in the substrate layer 10A, it is preferred that domains of the electronic conductor having sizes of 100 nm to 3 μm or about 100 nm to about 3 μm account for 60% or more, more preferably 80% or more, even more preferably 100% (i.e., there are no domains having sizes of less than 100 nm), of the total area of the domains. There may be no domains having sizes of more than 3 μm since the concentration of an electric field in such domains might lead to dielectric breakdown.

Examples of electronic conductors include powders of various materials, including carbon black such as Ketjenblack and acetylene black; pyrolytic carbon; graphite; various conductive metals and alloys such as aluminum, copper, nickel, and stainless steel; various conductive metal oxides such as tin oxide, indium oxide, titanium oxide, tin oxide-antimony oxide solid solutions, and tin oxide-indium oxide solid solutions; insulating materials coated with conductors; and conductive polymers such as polypyrrole and polyaniline.

Among these, carbon black may be used to reduce an environmental change in belt resistance. For example, oxidized carbon black (e.g., carbon black modified on its surface with functional groups such as carboxyl, quinone, lactone, and hydroxyl) having a pH of 5 or less (preferably 4.5 or less, more preferably 4.0 or less) may be used for reasons of electrical resistance stability over time and electric field dependence (i.e., to reduce the concentration of an electric field formed by a transfer voltage).

The electronic conductor preferably has an average primary particle size of, for example, 35 nm or less, more preferably 24 nm or less, even more preferably 16 nm or less, so that it readily aggregates to form domains having sizes of 100 nm to 3 μm or about 100 nm to about 3 μm.

In particular, carbon black having an average primary particle size of 24 nm or less may form fine and uniform conductive points. This may reduce a decrease in resistance due to discharge degradation in the belt surface.

Whereas carbon black having a smaller average primary particle size may be used for the reasons described above, carbon black having a particle size of 10 nm or more (preferably 12 nm or more) may be used for the following reason. Carbon black having an extremely small particle size is difficult to handle because of its low powder density and also forms a thixotropic dispersion because of its large surface area.

The average primary particle size of carbon black may be determined by the following procedure.

A test sample having a thickness of 200 nm is cut from the substrate layer 10A of the conductive member using a microtome and is examined under a transmission electron microscope (TEM). The sizes of 50 primary particles of carbon black are measured, and the average primary particle size is calculated as the average size of those particles.

Depending on the target resistance, the electronic conductor is preferably present in the substrate layer 10A in an amount of 1% to 50% by mass, more preferably 10% to 40% by mass, even more preferably 20% to 30% by mass, of all the components of the substrate layer 10A so that 20 to 50 or about 20 to about 50 domains formed by aggregate particles of the electronic conductor and having sizes of 100 nm to 3 μm or about 100 nm to about 3 μm are present in a 10 μm×10 μm square.

The above electronic conductors may be used alone or in combination.

Insulating or semiconductive particles may be added to the substrate layer 10A to adjust the volume resistivity of the substrate layer 10A. Examples of such materials include silica and zinc oxide (flowers of zinc).

The substrate layer 10A may further contain rubber ingredients such as fillers, rubber chemicals, and colorants.

Examples of fillers include titanium oxide, magnesium oxide, calcium carbonate, calcium sulfate, clay, and talc. Examples of rubber chemicals include vulcanizing agents, accelerators, antioxidants, plasticizers, and process oils. Examples of colorants include various pigments.

Other ingredients such as acid acceptors and reinforcing agents may also be added.

The thickness of the substrate layer 10A may be selected depending on the application. For example, if the conductive member is a transport/transfer belt, the substrate layer 10A preferably has a thickness of 100 to 1,000 μm, more preferably 300 to 600 μm, for several reasons, such as strength as a transport/transfer belt, reduced permanent elongation, prevention of fractures and tears during belt polishing, and surface smoothness.

Surface Layer

The surface layer 10B is optionally provided on the substrate layer 10A. The surface layer 10B contains, for example, a resin material, a conductor, and optionally other known additives.

The substrate layer 10A, which is made of a rubber or other material, tends to crease, and discharge products readily adhere to the substrate layer 10A during image-forming operation. The surface layer 10B provided on the outer surface of the substrate layer 10A may reduce the formation of creases and the adhesion of discharge products and other contaminants such as toner.

Resin

Examples of resins that may be present in the surface layer 10B include polyurethanes, polyesters, and acrylic resins.

Conductor

Examples of conductors that may be present in the surface layer 10B include electronic conductors and ionic conductors.

Among these, electronic conductors may be used to reduce an environmental change in belt resistance. Specifically, carbon black may be used.

For example, oxidized carbon black (e.g., carbon black modified on its surface with functional groups such as carboxyl, quinone, lactone, and hydroxyl) having a pH of 5 or less (preferably 4.5 or less, more preferably 4.0 or less) may be used for reasons of electrical resistance stability over time and electric field dependence (i.e., to reduce the concentration of an electric field formed by a transfer voltage).

The carbon black having a pH of 5 or less is similar to that described above for the electronic conductor present in the substrate layer 10A.

The content of the conductor in the surface layer 10B may be selected depending on the target resistance. For example, the conductor is present in an amount of 1% to 50% by mass, preferably 2% to 40% by mass, more preferably 4% to 30% by mass, of all the components of the surface layer 10B.

The surface layer 10B may contain a single conductor or a combination of two or more conductors.

The surface layer 10B preferably has a thickness of, for example, 2 to 30 μm, more preferably 5 to 15 μm.

Properties of Conductive Member

Surface Resistivity and Volume Resistivity

If the conductive member 10 according to this exemplary embodiment is a transport/transfer belt, the outer surface of the conductive member 10 preferably has a surface resistivity of 8.5 to 11.0 log Ω/sq, more preferably 10.0 to 11.0 log Ω/sq.

If the conductive belt member 10 according to this exemplary embodiment is a transport/transfer belt, the entire conductive belt member 10 preferably has a volume resistivity of 10.0 to 12.5 log Ω·cm or about 10.0 to about 12.5 log Ω·cm, more preferably 10.0 to 11.6 log Ω·cm or about 10.0 to about 11.6 log Ω·cm. If the conductive belt member 10 according to this exemplary embodiment has a volume resistivity of 10.0 log Ω·cm or more, it may be possible to prevent poor transfer at the edges of a sheet due to current leakage to the non-paper-feed area. If the conductive belt member 10 according to this exemplary embodiment has a volume resistivity of 12.5 log Ω·cm or less, it may be possible to avoid problems resulting from discharge due to increased transfer voltage.

The surface resistivity may be determined as follows. The surface resistivity may be determined using a circular electrode (e.g., UR Probe for Hiresta IP available from Mitsubishi Petrochemical Co., Ltd.) in accordance with JIS K 6911

Figure 3A:
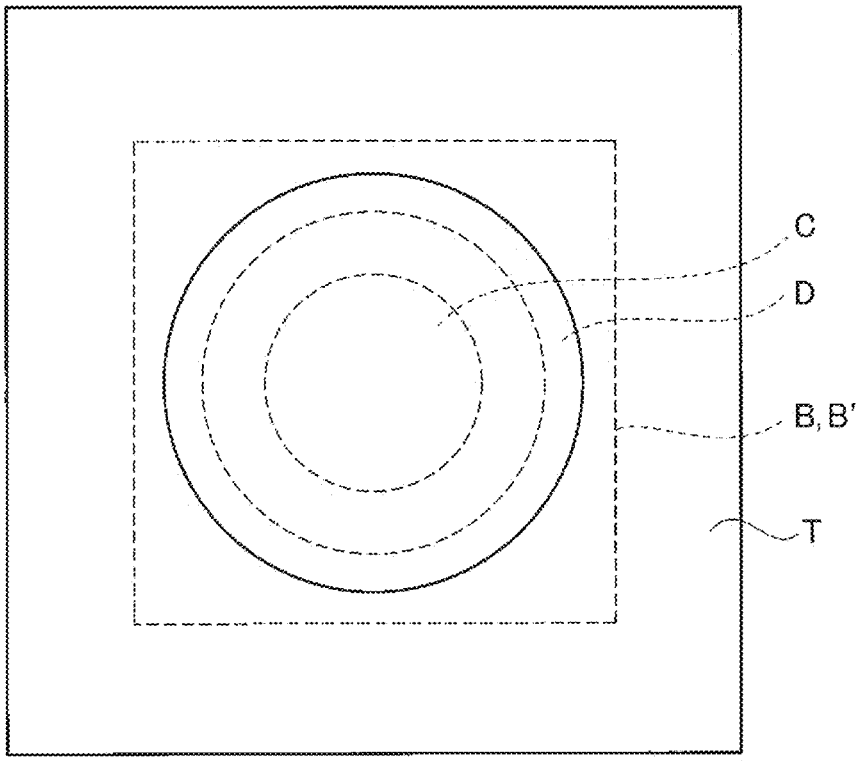
FIGS. 3A and 3B are a schematic plan view and a schematic sectional view, respectively, of an example circular electrode.
Figure 3B:
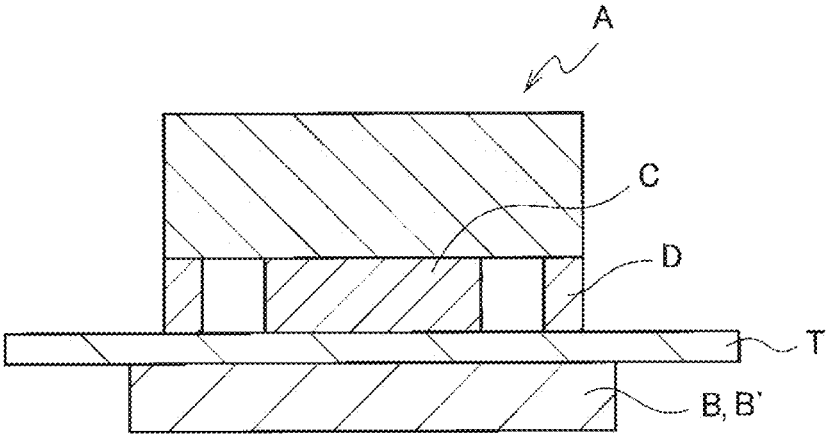

(1995). The procedure for determining the surface resistivity will now be described with reference to FIGS. 3A and 3B. FIGS. 3A and 3B are a schematic plan view and a schematic sectional view, respectively, of an example circular electrode. The circular electrode shown in FIGS. 3A and 3B includes a first voltage-applying electrode A and an insulator plate B. The first voltage-applying electrode A includes a cylindrical electrode part C and an annular electrode part D having an inner diameter larger than the outer diameter of the cylindrical electrode part C. The annular electrode part D surrounds the cylindrical electrode part C at a predetermined distance. A belt T is held between the cylindrical electrode part C and annular electrode part D of the first voltage-applying electrode A and the insulator plate B. A voltage V (V) is applied between the cylindrical electrode part C and the annular electrode part D of the first voltage-applying electrode A, and the current I (A) that flows therebetween is measured. The surface resistivity ρs (Ω/sq) of the transfer surface of the belt T is calculated by the following equation:

$$\rho s=\pi\times(D+d)/(D-d)\times(V/I)$$

where d (mm) is the outer diameter of the cylindrical electrode part C, and D (mm) is the inner diameter of the annular electrode part D.

The surface resistivity is calculated from the current measured using the circular electrode (UR Probe for Hiresta IP available from Mitsubishi Petrochemical Co., Ltd., outer diameter of cylindrical electrode part C: 16 mm, inner diameter of annular electrode part D: 30 mm, outer diameter of annular electrode part D: 40 mm) in an environment at 22° C. and 55% RH after a voltage of 500 V is applied for ten seconds.

The volume resistivity may be determined using a circular electrode (e.g., UR Probe for Hiresta IP available from Mitsubishi Petrochemical Co., Ltd.) in accordance with JIS K 6911 (1995). The procedure for determining the volume resistivity will now be described with reference to FIGS. 3A and 3B. This procedure uses the same instrument as the procedure for determining the surface resistivity except that the circular electrode shown in FIGS. 3A and 3B includes a second voltage-applying electrode B' instead of the insulator plate B used in the determination of the surface resistivity. The belt T is held between the cylindrical electrode part C and annular electrode part D of the first voltage-applying electrode A and the second voltage-applying electrode B'. A voltage V (V) is applied between the cylindrical electrode part C of the first voltage-applying electrode A and the second voltage-applying electrode B', and the current I (A) that flows therebetween is measured. The volume resistivity ρs (Ω·cm) of the belt T is calculated by the following equation:

$$\rho v=19.6\times(V/I)\times t$$

where t is the thickness of the belt T.

The volume resistivity is calculated from the current measured using the circular electrode (UR Probe for Hiresta IP available from Mitsubishi Petrochemical Co., Ltd., outer diameter of cylindrical electrode part C: 16 mm, inner diameter of annular electrode part D: 30 mm, outer diameter of annular electrode part D: 40 mm) in an environment at 22° C. and 55% RH after a voltage of 500 V is applied for ten seconds.

The coefficient 19.6 in the above equation is an electrode coefficient for conversion into resistivity. This coefficient is calculated as $\pi d^2/4$ t from the outer diameter d (mm) of the cylindrical electrode part C and the thickness t (cm) of the specimen. The thickness of the belt T may be measured using a CTR-1500E eddy current thickness meter available from Sanko Electronic Laboratory Co., Ltd.

The surface resistivity and volume resistivity of the conductive belt member 10 according to this exemplary embodiment may be controlled depending on, for example, the type of conductive organic polymer material, the type of conductor, and the amount of conductor added.

Method for Manufacturing Conductive Member

The conductive member according to this exemplary embodiment may be manufactured by any method. For example, the conductive belt member 10 having the layer structure shown in FIG. 2 may be manufactured by any method provided that the substrate layer 10A includes a matrix containing a conductive organic polymer material and domains formed by aggregate particles of an electronic conductor and having sizes of 100 nm to 3 μm or about 100 nm to about 3 μm and that 20 to 50 or about 20 to about 50 domains are present in a 10 μm×10 μm square in the substrate layer 10A. For example, the conductive belt member 10 may be manufactured by forming the substrate layer 10A and then forming the surface layer 10B on the outer surface of the substrate layer 10A, as described below.

The substrate layer 10A may be formed as follows. A rubber composition containing, for example, rubber materials such as chloroprene rubber and EPDM, an electronic conductor, a vulcanizing agent, and an accelerator is introduced and blended in a Banbury mixer.

The rubber composition is further blended on a roll mill and is then molded into an endless belt through a tube crosshead extruder. The molded rubber composition is vulcanized by heating with pressurized steam in a vulcanizing can to form a substrate rubber. The resulting substrate is fitted around a metal tube, and the surface thereof is polished to obtain a substrate layer 10A having the shape of an endless belt.

If the substrate layer 10A is formed as described above, for example, EPDM and carbon black may be blended to prepare a rubber composition in advance before the rubber composition is further blended with other ingredients such as other rubber materials, a vulcanizing agent, and an accelerator. This may facilitate the formation of a substrate layer in which 20 to 50 or about 20 to about 50 domains formed by aggregate particles of the electronic conductor and having sizes of 100 nm to 3 μm or about 100 nm to about 3 μm are present in a 10 μm×10 μm square. The rubber composition may optionally be passed through a mesh screen to adjust the size of the aggregate particles of the electron conductor in the rubber composition.

The surface layer 10B may be formed on the outer surface of the substrate layer 10A by any method. For example, a coating composition for forming the surface layer 10B in which a resin and a conductor are dispersed is applied to the substrate layer 10A by a process such as dip coating, spray coating, electrostatic coating, or roller coating and is dried to form the surface layer 10B.

The conductive belt member 10 according to this exemplary embodiment may be used for various applications in an image-forming apparatus that transfers a toner image from a surface of an image carrier (electrophotographic photoreceptor) to an intermediate transfer belt and then transfers the toner image from the intermediate transfer belt to a recording medium such as paper. Examples of such applications include a transport/transfer belt that is disposed opposite an intermediate transfer belt in a second transfer area and that transports a recording medium in the second transfer area, a transport/transfer belt that transports a recording medium such as paper in a transfer area where a toner image is directly transferred from an image carrier to the recording medium while the recording medium is being transported, and an intermediate transfer belt to which a toner image is transferred from a surface of an image carrier in an image-forming apparatus.

Image-Forming Apparatus

An image-forming apparatus according to an exemplary embodiment includes an image carrier having a surface, a charging unit that charges the surface of the image carrier, an electrostatic-latent-image forming unit that forms an electrostatic latent image on the surface of the image carrier, a developing unit that develops the electrostatic latent image on the surface of the image carrier with a developer containing a toner to form a toner image, a transfer unit that includes a transfer belt including the conductive belt member according to the foregoing exemplary embodiment and that transfers the toner image from the surface of the image carrier to a recording medium, and a fixing unit that fixes the toner image to the recording medium.

If the image-forming apparatus according to this exemplary embodiment is configured to transfer a toner image from the image carrier to a recording medium via an intermediate transfer belt, the transfer belt including the conductive belt member according to the foregoing exemplary embodiment may be used as a transport/transfer belt that is disposed opposite the intermediate transfer belt in a second transfer area and that transfers the toner image to the recording medium while transporting the recording medium. Alternatively, if the image-forming apparatus according to this exemplary embodiment is configured to directly transfer a toner image from the surface of the image carrier to a recording medium, the transfer belt including the conductive belt member according to the foregoing exemplary embodiment may be used as a transport/transfer belt that is disposed opposite the image carrier and that transfers the toner image from the surface of the image carrier to the recording medium while transporting the recording medium.

The image-forming apparatus according to this exemplary embodiment may be, for example, a monochrome image-forming apparatus that includes a single developing device containing a toner, a color image-forming apparatus that sequentially transfers toner images from an image carrier to an intermediate transfer belt, or a tandem color image-forming apparatus that includes multiple image carriers equipped with developing devices for different colors and arranged in tandem along an intermediate transfer belt.

Figure 4:
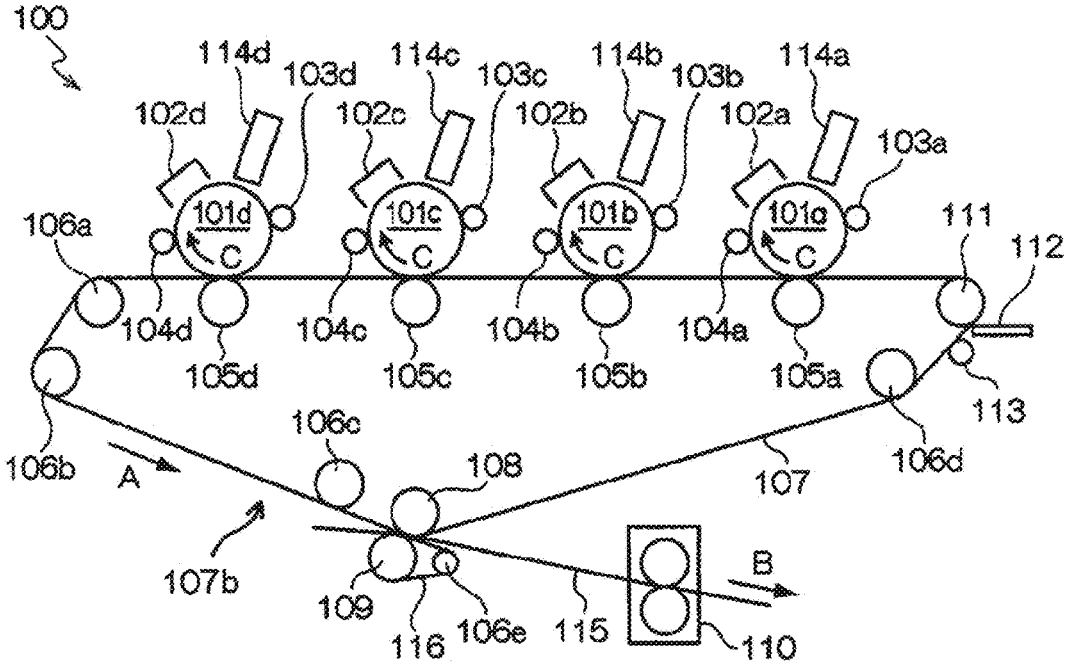
FIG. 4 is a schematic view of an example image-forming apparatus according to an exemplary embodiment.

FIG. 4 is a schematic view of an example image-forming apparatus according to this exemplary embodiment. The image-forming apparatus shown in FIG. 4 uses the conductive belt member according to the foregoing exemplary embodiment as a second transfer belt 116 (an example of a transport/transfer belt).

As shown in FIG. 4, an example image-forming apparatus 100 according to this exemplary embodiment is a tandem color image-forming apparatus. The image-forming apparatus 100 includes four image carriers 101*a* to 101*d*, each composed of an electrophotographic photoreceptor, around which are arranged, in sequence in the rotational direction, charging devices 102*a* to 102*d*, exposure devices 114*a* to 114*d*, developing devices 103*a* to 103*d*, first transfer devices (first transfer rollers) 105*a* to 105*d*, and image-carrier cleaning devices 104*a* to 104*d*. The image-forming apparatus 100 may further include erase devices that eliminate residual potential from the surfaces of the image carriers 101*a* to 101*d* after transfer.

An intermediate transfer belt 107 is supported and maintained in tension by support rollers 106*a* to 106*d*, a drive roller 111, and a counter roller 108, thereby forming a transfer unit 107*b*. The support rollers 106*a* to 106*d*, the drive roller 111, and the counter roller 108 allow the intermediate transfer belt 107 to move the image carriers 101*a* to 101*d* and the first transfer rollers 105*a* to 105*d* in the direction of arrow A while being in contact with the surfaces of the image carriers 101*a* to 101*d*. The first transfer rollers 105*a* to 105*d* are disposed opposite the image carriers 101*a* to 101*d* with the intermediate transfer belt 107 therebetween to form first transfer areas. A first transfer voltage is applied to the first transfer areas between the image carriers 101*a* to 101*d* and the first transfer rollers 105*a* to 105*d*.

The counter roller 108 and a second transfer roller 109, serving together as a second transfer device, are disposed opposite each other with the intermediate transfer belt 107 and a second transfer belt 116 therebetween. The second transfer belt 116 is supported by the second transfer roller 109 and a support roller 106*e*. A recording medium 115 such as paper passes through the area between the intermediate transfer belt 107 and the second transfer roller 109 in the direction of arrow B while being in contact with the surface of the intermediate transfer belt 107 and then passes through a fixing device 110. The second transfer roller 109 is disposed opposite the counter roller 108 with the intermediate transfer belt 107 and the second transfer belt 116 therebetween to form a second transfer area. A second transfer voltage is applied to the second transfer area between the second transfer roller 109 and the counter roller 108. Intermediate-transfer-belt cleaning devices 112 and 113 are disposed in contact with the intermediate transfer belt 107 downstream of the second transfer area.

In the thus-configured multicolor image-forming apparatus 100, the image carrier 101*a* is rotated in the direction of arrow C, and the surface thereof is charged by the charging device 102*a* and is exposed to light such as a laser beam by the exposure device 114*a* to form an electrostatic latent image of the first color. The resulting electrostatic latent image is developed (i.e., made visible) by the developing device 103*a* with a developer containing a toner of the first color to form a toner image. The developing devices 103*a* to 103*d* contain toners of different colors (e.g., yellow, magenta, cyan, and black).

As the toner image formed on the image carrier 101*a* passes through the first transfer area, the toner image is electrostatically transferred (first transfer) to the intermediate transfer belt 107 by the first transfer roller 105*a*. Toner images of the second to fourth colors are then sequentially transferred to the intermediate transfer belt 107 on which the toner image of the first color is supported in superimposed registration with each other by the first transfer rollers 105*b* to 105*d* to form a multicolor toner image.

As the multicolor toner image formed on the intermediate transfer belt 107 passes through the second transfer area, the multicolor toner image is electrostatically simultaneously transferred to a recording medium 115 being transported by the second transfer belt 116. After the toner image is transferred to the recording medium 115, the recording medium 115 is transported to the fixing device 110. The toner image is fixed to the recording medium 115 with heat or pressure, or both, by the fixing device 110 before the recording medium 115 is output from the image-forming apparatus 100.

After the first transfer, the image-carrier cleaning devices 104*a* to 104*d* remove residual toner from the image carriers 101*a* to 101*d*. After the second transfer, the intermediate-transfer-belt cleaning devices 112 and 113 remove residual toner from the intermediate transfer belt 107 to prepare for the next image-forming process.

Image Carrier

A wide variety of known electrophotographic photoreceptors may be used as the image carriers 101*a* to 101*d*. Examples of such electrophotographic photoreceptors include inorganic photoreceptors, which include an inorganic photosensitive layer, and organic photoreceptors, which include an organic photosensitive layer. Examples of organic photoreceptors include double-layer organic photoreceptors, which include a charge generation layer that generates charge upon exposure to light and a charge transport layer that transports the resulting charge, and single-layer organic photoreceptors, which include a layer having both a charge generation function and a charge transport function. Examples of inorganic photosensitive layers include those including an amorphous silicon photosensitive layer.

The image carriers 101*a* to 101*d* may be of any shape, including known shapes such as a cylindrical drum, a sheet, and a plate.

Charging Device

The charging devices 102*a* to 102*d* may be of any type, including a wide variety of known charging devices. Examples of such known charging devices include contact charging devices, which include conductive (the term "conductive" as used herein refers to a volume resistivity of, for example, less than $10^7$ Ω·cm) or semiconductive (the term "semiconductive" as used herein refers to a volume resistivity of, for example, $10^7$ to $10^{13}$ Ω·cm) members such as rollers, brushes, films, and rubber blades, as well as corotron and scorotron charging devices, which use corona discharge. For example, contact charging devices may be used.

Although the charging devices 102*a* to 102*d* typically apply a direct current to the image carriers 101*a* to 101*d*, they may instead apply a direct current on which an alternating current is superimposed to the image carriers 101*a* to 101*d*.

Exposure Device

The exposure devices 114*a* to 114*d* may be of any type, including a wide variety of known exposure devices. Examples of such known exposure devices include light sources such as semiconductor lasers, light-emitting diodes (LEDs), and liquid crystal shutters and optical devices capable of exposing the surfaces of the image carriers 101*a* to 101*d* to a predetermined image pattern of light emitted from a light source via a polygon mirror.

Developing Device

The developing devices 103*a* to 103*d* may be of any type selected depending on the purpose, including known contact and noncontact developing devices that develop an electrostatic latent image with a one-component or two-component developer using a member such as a brush or roller.

First Transfer Roller

The first transfer rollers 105*a* to 105*d* may have a single-layer or multilayer structure. For example, if the first transfer rollers 105*a* to 105*d* have a single-layer structure, they may be made of a foamed or unfoamed rubber such as silicone rubber, urethane rubber, or EPDM containing a suitable amount of conductive particles such as carbon black.

Image-Carrier Cleaning Device

The image-carrier cleaning devices 104*a* to 104*d* remove residual toner from the surfaces of the image carriers 101*a* to 101*d* after the first transfer. The image-carrier cleaning devices 104*a* to 104*d* include a cleaning member such as a blade, brush, or roller. For example, a cleaning blade may be used. Examples of materials used for cleaning blades include urethane rubber, neoprene rubber, and silicone rubber.

Second Transfer Roller

The second transfer roller 109 may have any layer structure. For example, the second transfer roller 109 may have a three-layer structure including, in sequence, a core layer, an intermediate layer, and a coating layer. The core layer may be made of, for example, a foamed rubber such as silicone rubber, urethane rubber, or EPDM in which conductive particles are dispersed. The intermediate layer may be made of, for example, an unfoamed rubber such as silicone rubber, urethane rubber, or EPDM. The coating layer may be made of a tetrafluoroethylene-hexafluoropropylene copolymer or perfluoroalkoxy resin. The second transfer roller 109 may have a volume resistivity of $10^7$ Ω·cm or less. Alternatively, the second transfer roller 109 may have a two-layer structure including no intermediate layer.

Counter Roller

The counter roller 108 serves as a counter electrode for the second transfer roller 109. The counter roller 108 may have a single-layer or multilayer structure. For example, the counter roller 108 may have a single-layer structure made of a foamed or unfoamed rubber such as silicone rubber, urethane rubber, or EPDM containing a suitable amount of conductive particles such as carbon black. Alternatively, the counter roller 108 may have a two-layer structure including an elastic layer made of a rubber material as mentioned above and a high-resistivity layer formed on the outer surface of the elastic layer.

Typically, a voltage of 1 to 6 kV is applied between the cores of the counter roller 108 and the second transfer roller 109. Alternatively, the voltage may be applied between an electrode member with good electrical conductivity disposed in contact with the counter roller 108 and the second transfer roller 109. Examples of such electrode members include metal rollers, conductive rubber rollers, conductive brushes, metal plates, and conductive resin plates.

Fixing Device

A wide variety of known fixing devices may be used as the fixing device 110, including heat roller fixing devices, pressure roller fixing devices, and flash fixing devices.

Intermediate-Transfer-Belt Cleaning Device

The intermediate-transfer-belt cleaning devices 112 and 113 include a cleaning member such as a blade, brush, or roller. For example, a cleaning blade may be used. Examples of materials used for cleaning blades include urethane rubber, neoprene rubber, and silicone rubber.

Figure 5:
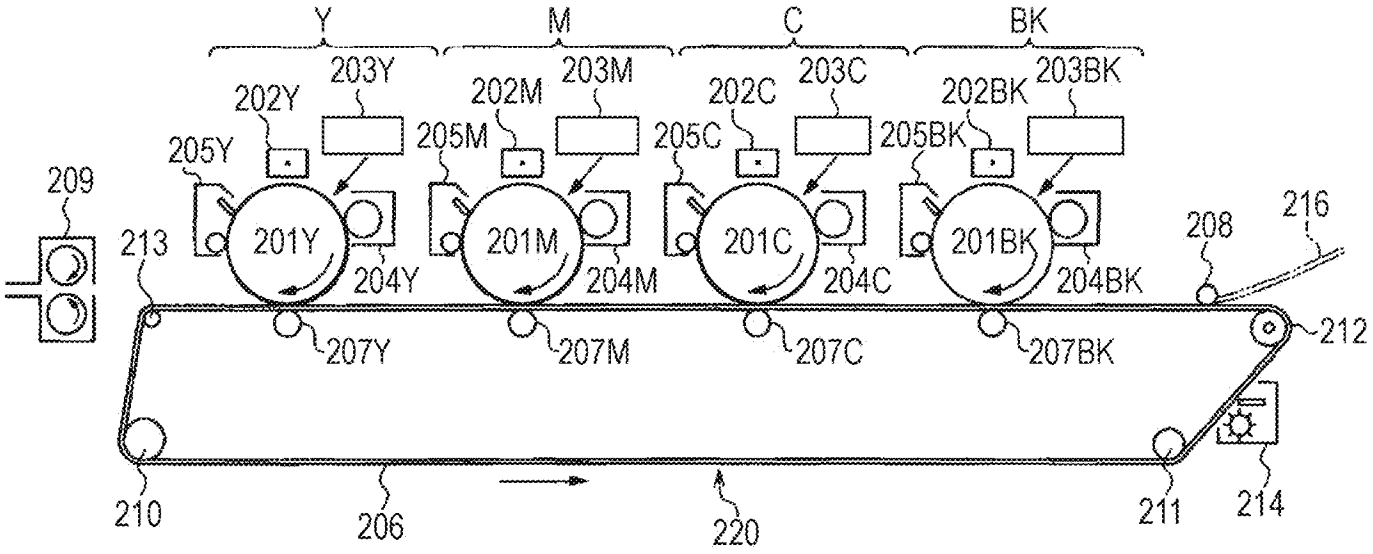
FIG. 5 is a schematic view of another example image-forming apparatus according to the exemplary embodiment.

FIG. 5 is a schematic view of another example image-forming apparatus according to this exemplary embodiment. The image-forming apparatus shown in FIG. 5 uses the conductive belt member according to the foregoing exemplary embodiment as a transport/transfer belt 206.

The image-forming apparatus shown in FIG. 5 includes four units Y, M, C, and BK. The four units Y, M, C, and BK include photoreceptor drums 201Y, 201M, 201C, and 201BK around which are arranged charging devices 202Y, 202M, 202C, and 202BK, exposure devices 203Y, 203M, 203C, and 203BK, developing devices (yellow developing device 204Y, magenta developing device 204M, cyan developing device 204C, and black developing device 204BK), and photoreceptor-drum cleaning members 205Y, 205M, 205C, and 205BK. The photoreceptor drums 201Y, 201M, 201C, and 201BK rotate clockwise, as indicated by the arrows.

The four units Y, M, C, and BK are arranged in parallel along the transport/transfer belt 206 in the order of the unit BK, the unit C, the unit M, and the unit Y. The four units Y, M, C, and BK, however, may be arranged in any suitable order depending on the method for forming an image, for example, in the order of the unit BK, the unit Y, the unit C, and the unit M.

The transport/transfer belt 206 is supported and maintained in tension from inside by belt support rollers 210, 211, 212, and 213, thereby forming a transfer unit 220. The transport/transfer belt 206 rotates counterclockwise, as indicated by the arrow, at the same peripheral velocity as the photoreceptor drums 201Y, 201M, 201C, and 201BK. The transport/transfer belt 206 is in contact with the photoreceptor drums 201Y, 201M, 201C, and 201BK between the belt support rollers 212 and 213. The transport/transfer belt 206 is provided with a belt-cleaning member 214.

The transfer rollers 207Y, 207M, 207C, and 207BK are disposed inside the transport/transfer belt 206 and opposite the areas where the transport/transfer belt 206 is in contact with the photoreceptor drums 201Y, 201M, 201C, and 201BK. The transfer rollers 207Y, 207M, 207C, and 207BK are disposed opposite the photoreceptor drums 201Y, 201M, 201C, and 201BK with the transport/transfer belt 206 therebetween to form transfer areas where toner images are transferred to a sheet (medium) 216. As shown in FIG. 5, the transfer rollers 207Y, 207M, 207C, and 207BK may be disposed directly below the photoreceptor drums 201Y, 201M, 201C, and 201BK or may be shifted from those positions.

A fixing device 209 is disposed downstream of the transfer areas between the transport/transfer belt 206 and the photoreceptor drums 201Y, 201M, 201C, and 201BK.

A sheet transport roller 208 transports the sheet 216 to the transport/transfer belt 206.

In the unit BK of the image-forming apparatus shown in FIG. 5, the photoreceptor drum 201BK is rotated while the charging device 202BK is activated to charge the surface of the photoreceptor drum 201BK to the target polarity and potential. The charged surface of the photoreceptor drum 201BK is then exposed to an image pattern of light by the exposure device 203BK to form an electrostatic latent image on the surface of the photoreceptor drum 201BK.

The electrostatic latent image is then developed by the black developing device 204BK to form a toner image on the surface of the photoreceptor drum 201BK. The developer used herein may be a one-component or two-component developer.

The toner image passes through the transfer area between the photoreceptor drum 201BK and the transport/transfer belt 206. The sheet 216 is electrostatically attracted to the transport/transfer belt 206 and is transported to the transfer area. A transfer bias applied by the transfer roller 207BK forms an electric field that transfers the toner image to the surface of the sheet 216.

Subsequently, residual toner is removed from the photoreceptor drum 201BK by the photoreceptor-drum cleaning member 205BK. The photoreceptor drum 201BK is then subjected to the next image transfer process.

The units C, M, and Y repeat the above image transfer process.

After toner images are transferred to the sheet 216 by the transfer rollers 207Y, 207M, 207C, and 207BK, the sheet 216 is transported to the fixing device 209, and the toner images are fixed to the sheet 216.

In this way, the target image is formed on the sheet 216.

Transfer Unit

A transfer unit for an image-forming apparatus (hereinafter also referred to as "transfer unit") according to an exemplary embodiment includes a transfer belt including the conductive belt member according to the foregoing exemplary embodiment and multiple rollers that support and maintain the transfer belt in tension.

For example, the transfer unit according to this exemplary embodiment may include a conductive belt member and multiple rollers that support and maintain the conductive belt member in tension, at least one of the rollers having a pair of limiting members. For example, if this transfer unit is used in an image-forming apparatus, the conductive belt member may be less likely to fracture as it meanders and is subjected to a mechanical load due to contact with the limiting members of the roller.

If the conductive belt member according to this exemplary embodiment is used as a transport/transfer belt, the transfer unit according to this exemplary embodiment may include a roller that supports the conductive belt member and that transfers a toner image from a surface of a photoreceptor (image carrier) or an intermediate transfer belt to the conductive belt member. The transfer unit according to this exemplary embodiment may further include other members. Any number of rollers may be arranged to support the conductive belt member depending on the use. The thus-configured transfer unit is incorporated and used in an image-forming apparatus.

Figure 6:
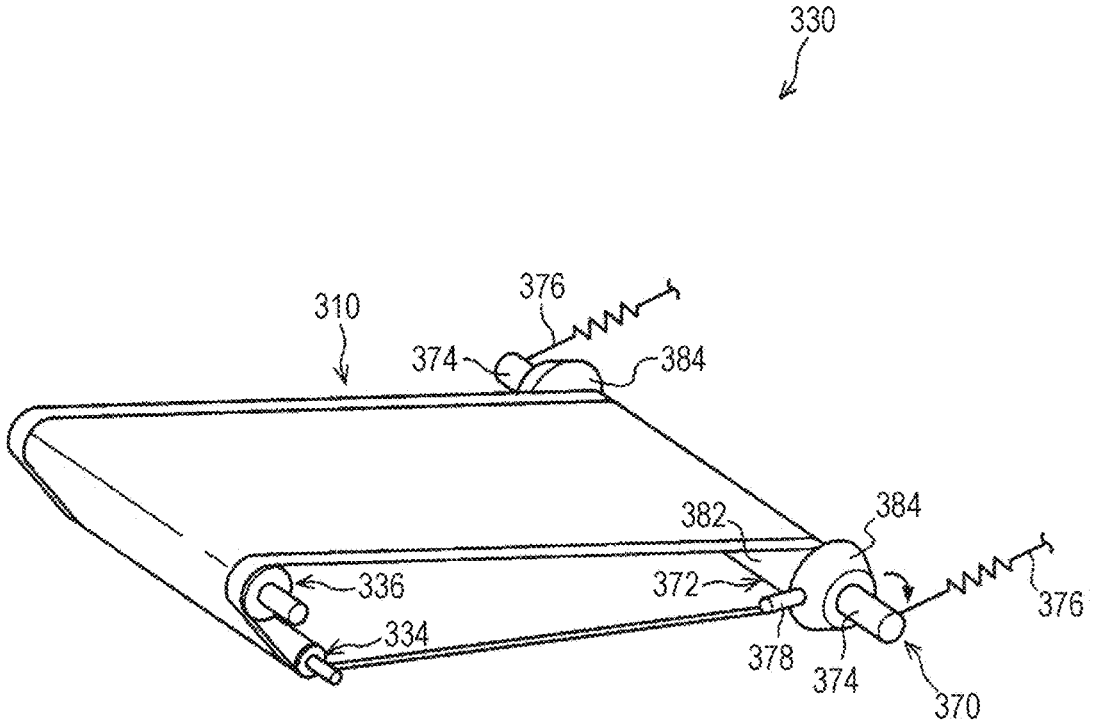
FIG. 6 is a schematic perspective view of an example transfer unit for an image-forming apparatus according to an exemplary embodiment.

An example of the transfer unit according to this exemplary embodiment is shown in FIG. 6. FIG. 6 is a schematic perspective view of an example transfer unit. A transfer unit 330 shown in FIG. 6 includes a conductive belt member 310, a support roller 334, a drive roller 336, and a steering mechanism 370. The conductive belt member 310 is supported and maintained in tension by the support roller 334, the drive roller 336, and a steering roller 372 of the steering mechanism 370.

The steering mechanism 370 limits the movement of the conductive belt member 310 in the axial direction of the drive roller 336 as the conductive belt member 310 is rotated by the drive roller 336. As shown in FIG. 6, the steering mechanism 370 includes the steering roller 372, a pair of slide bearings 374, a pair of extension coil springs 376, and a pair of contact members 378. The steering roller 372 supports the conductive belt member 310 and rotates about the axis.

The steering roller 372 includes a shaft (not shown), a cylinder 382, and a pair of guides 384 (an example of a limiting member). The cylinder 382 is secured around the shaft. The guides 384 are secured around the shaft and in contact with the end surfaces of the cylinder 382 such that the large-diameter sides of the guides 384 face each other. When the edges of the conductive belt member 310 push the guides 384 as it meanders, the guides 384 butt against the pair of contact members 378 and tilt the steering roller 372, thereby reducing the amount of meandering. The steering roller 372 continues to rotate while the pushing force of the edges of the conductive belt member 310 is in balance with the opposite meandering force.

The pair of slide bearings 374 are disposed at the ends of the steering roller 372 and support the steering roller 372 so as to be rotatable about the axis. The pair of extension coil springs 376 support the pair of slide bearings 374 to maintain the conductive belt member 310 in tension. For example, the steering roller 372 is configured to be moved and tilted relative to the drive roller 336 as the conductive belt member 310 vibrates or meanders during rotation.

Whereas transport/transfer belts have been described as examples of conductive members in the foregoing exemplary embodiments, they need not be belts, but may instead be other conductive members for use in image-forming apparatuses, including charging members and transfer rollers.

EXAMPLES

The present invention is further illustrated by the following examples, although these examples are not intended to limit the invention. In the description below, all parts and percentages are by mass unless otherwise specified.

Example 1

Formation of Substrate Rubber

A rubber composition of Rubber Formulation 1 is prepared by mixing the following rubber ingredients: Rubber Formulation 1

Chloroprene rubber (CR) (TSR-61 available from Tosoh Corporation): 35 parts

Epichlorohydrin rubber (ECO) (610 available from Osaka Soda Co., Ltd.): 15 parts Ethylene-propylene-diene rubber (EPDM) (EP33 available from JSR Corporation): 35 parts Nitrile-butadiene rubber (NBR) (DN211 available from Zeon Corporation): 15 parts Sulfur (available from Tsurumi Chemical Industry Co., Ltd.): 0.5 part ZnO (available from Kyodo Chemical Co., Ltd.): 5 parts Accelerator (Nocceler M available from Ouchi Shinko Chemical Industrial Co., Ltd.): 1 part Stearic acid: 0.5 part Conductivity-imparting agent (carbon black, #3030B available from Mitsubishi Chemical Corporation): 23 parts The rubber composition of Rubber Formulation 1 is introduced and blended in a Banbury mixer and is then blended on a two-roll mill. The blended rubber composition is molded into an endless belt through a tube crosshead extruder.

The molded rubber composition is then vulcanized by heating with pressurized steam (at 126° C. and 1.5 kg/cm$^2$) in a vulcanizing can to form a substrate rubber. The resulting substrate rubber is fitted around a metal tube, and the surface thereof is polished to obtain a substrate rubber layer having the shape of an endless belt (having a diameter of 40 mm, a width of 340 mm, and a thickness of 492 μm).

Formation of Surface Layer

A coating composition for forming a surface layer is prepared by mixing 100 parts by mass of a silicone-modified acrylic urethane resin (JYL841 available from Acheson Japan Ltd.) and 20 parts by mass of carbon black (FW200 available from Evonik Degussa GmbH).

The resulting coating composition is applied to the surface of the substrate rubber layer by spray coating and is then dried by heating at 180° C. for 30 minutes to form a surface layer (having a thickness of 8 μm).

In this way, a conductive belt member having a diameter of 40 mm, a width of 340 mm, and a thickness of 500 μm is fabricated.

Examples 2 and 3 and Comparative Examples 1 to 7

Conductive belt members are fabricated as in Example 1 except that the rubber composition of Rubber Formulation 1 used in the formation of the substrate rubber in Example 1 is replaced with rubber compositions of the formulations shown in Table 1.

Evaluation

The conductive belt member fabricated in each example is tested and evaluated as follows.

Determination of Volume Resistivity

The volume resistivity of the conductive belt member fabricated in each example is determined using a circular electrode (e.g., UR Probe for Hiresta IP available from Mitsubishi Petrochemical Co., Ltd.) in accordance with JIS K 6911 (1995).

The volume resistivity is calculated from the current measured using the circular electrode (UR Probe for Hiresta IP available from Mitsubishi Petrochemical Co., Ltd.) in an environment at 22° C. and 55% RH after a voltage of 500 V is applied for ten seconds.

The volume resistivity is calculated by converting the measured resistance with the electrode area and the thickness.

Conduction Test

The conductive belt member fabricated in each example is fitted around a metal tube, and a metal pipe is provided as a counter electrode. While the metal tube is rotated at 530 mm/s in an environment at 10° C. and 15% RH, a voltage is applied to the opposite metal pipe using a high-voltage power supply (610C available from Trek, Inc.) for 120 hours. The voltage is adjusted so that a current of −120 μA flows.

The resistances before and after the test are measured by the procedure described above, and the change in resistance after conduction is calculated.

Determination of Number of Conductive Points

The number of conductive points in the conductive belt member fabricated in each example is determined by the following procedure.

A specimen is prepared by cutting a small piece (specimen) from the conductive belt member, attaching a conductive double-sided tape to the surface of the specimen, and eliminating any static electricity from the specimen. The specimen is examined by conductive AFM (using a Nanoscope IIIa-D3100 available from Digital Instruments) in a 10 μm×10 μm area at a resolution of 512×512 pixels in air while a test voltage of −20 V is applied to the surface of the specimen. The points where a current of 3.0 pA or more flows between the probe and the conductive double-sided tape are determined to be conductive points (domains).

The number of conductive points is determined by image analysis (two or more adjacent conductive points are counted as one point). As used herein, the number of domains present in a 10 μm×10 μm square is determined by the procedure described above.

Figure 7:
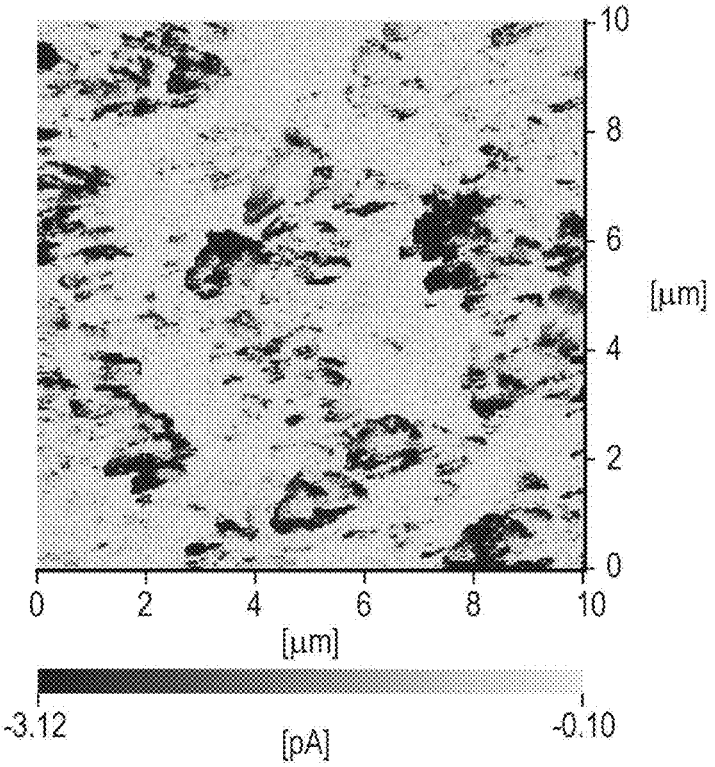
FIG. 7 is an atomic force microscopy (AFM) image of a portion of a cross-sectional surface of a conductive endless belt member fabricated in the Examples.

FIG. 7 is an AFM image of a cross-sectional surface of the conductive belt member fabricated in Example 1. High-contrast areas (black) are domains formed by aggregate particles of carbon black.

Determination of Domain Size

The conductive belt member fabricated in each example is cut using a single-edged razor to form a cross-sectional surface. The cross-sectional surface of the substrate layer is examined by SEM. Low-contrast areas are determined to be domains. The maximum size of each domain in one field of view is measured.

Figure 8:
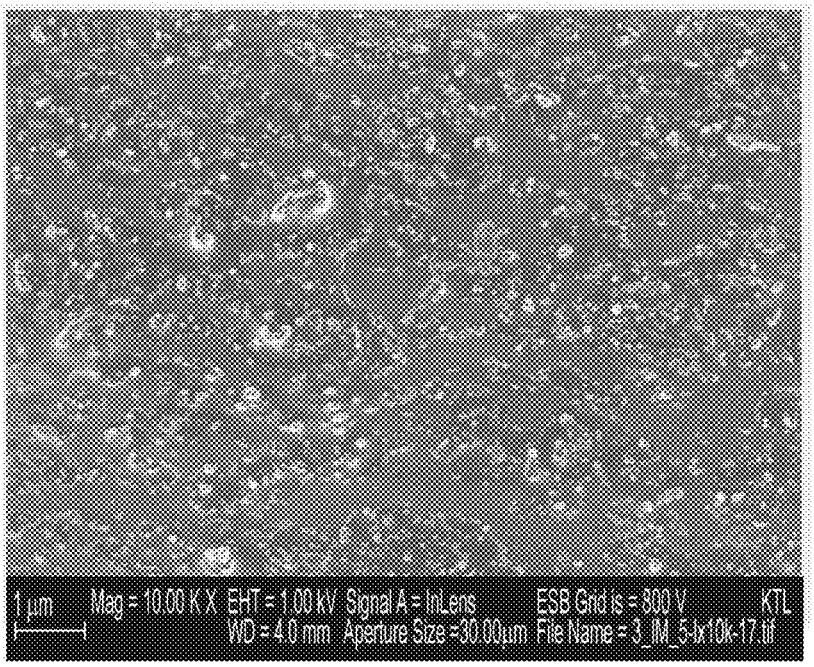
FIG. 8 is a scanning electron microscopy (SEM) image of a portion of a cross-sectional surface of a conductive endless belt member fabricated in the Examples.

FIG. 8 is an SEM image of a cross-sectional surface of the conductive belt member fabricated in Example 1. Low-contrast areas (white) are domains formed by aggregate particles of carbon black.

The conductive belt member fabricated in each example is examined for the number of domains having sizes of 100 nm to 3 μm in a 10 μm×10 μm square by the determination of the number of conductive points and the domain size.

Image Quality Evaluation

The conductive belt member fabricated in each example is mounted as a transport/transfer belt in a Color 1000 Press printer available from Fuji Xerox Co., Ltd. A halftone image with an image density of 200% is continuously printed on 100 sheets of paper (J paper available from Fuji Xerox Co., Ltd., size: A3, grammage: 82 g/m$^2$, thickness: 97 μm) in an environment at 10° C. and 15% RH. The resulting images are evaluated for image quality as follows.

The image quality evaluation is performed before and after the conduction test.

The evaluation criteria are as follows:

A: There is no color unevenness in the images.

B: There is slight color unevenness.

C: There are color unevenness and color dropout in part of the images.

D: There are color unevenness and color dropout over the entire images.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conductive member for an image-forming apparatus, comprising:

a conductive layer comprising:

a matrix comprising a conductive organic polymer material; and domains comprising aggregate particles of an electronically conductive conductivity-imparting agent and having sizes of about 100 nm to about 3 μm,

TABLE 1

| | | Example 1 | Example 2 | Example 3 | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|---|---|---|
| Formulation | EPDM | 35 | 40 | 35 | 25 | 30 | 30 | 30 | 100 | 40 | 40 |
| | CR | 35 | 30 | 35 | 35 | 40 | 40 | 40 | — | 30 | 30 |
| | ECO | 15 | 15 | 15 | 25 | 30 | 15 | 15 | — | 20 | 20 |
| | NBR | 15 | 15 | 15 | 15 | — | 15 | 15 | — | 10 | 10 |
| | CB | 23 | 25 | 24 | 28 | 28 | 20 | 21 | 25 | 25 | — |
| | Quaternary ammonium salt | — | — | — | — | | — | | — | | 5 |
| | Sulfur | 0.5 | 0.5 | 0.5 | 0.5 | 0.5 | 0.5 | 0.5 | 0.5 | 0.5 | 0.5 |
| | ZnO | 5 | 5 | 5 | 5 | 5 | 5 | 5 | 5 | 5 | 5 |
| | Accelerator | 1 | 1 | 1 | 1 | 1 | 1 | 1 | 1 | 1 | 1 |
| | Stearic acid | 0.5 | 0.5 | 0.5 | 0.5 | 0.5 | 0.5 | 0.5 | 0.5 | 0.5 | 0.5 |
| Number of conductive points (domains) having sizes of 100 nm to 3 μm in 10 μm × 10 μm square | | 45 | 25 | 30 | 100 | 80 | 12 | 15 | 10 | 40 | 0 (No domain-matrix structure) |
| Area percentage of conductive points having sizes of 100 nm to 3 μm among all conductive points in 10 μm × 10 μm square [%] | | 96% | 92% | 92% | 99% | 98% | 84% | 87% | 82% | 92% | 0 (No domain-matrix structure) |
| Maximum domain size [μm] | | 2.0 | 1.0 | 1.3 | 2.0 | 2.5 | 0.8 | 2.8 | 3.0 | 5.0 | 0 (No domain-matrix structure |
| Initial volume resistivity [logΩ · cm] | | 10.9 | 10.8 | 10.8 | 8.2 | 10.7 | 11.1 | 11.0 | 12.6 | 10.9 | 10.2 |
| Image quality evaluation (initial) | | A | A | A | D | A | A | A | D | B | C |
| Image quality evaluation (after conduction) | | A | A | A | C | C | D | D | D | D | D |
| Resistance before conduction [logΩ] | | 9.3 | 9.2 | 9.2 | 6.6 | 9.1 | 9.5 | 9.4 | 11.0 | 9.3 | 8.6 |
| Resistance after conduction [logΩ] | | 9.4 | 8.9 | 9.4 | 8.9 | 8.4 | 11.2 | 10.0 | 11.0 | 8.5 | 10.5 |
| Change in resistance after conduction test [ΔlogΩ] | | 0.1 | −0.3 | 0.2 | 2.3 | −0.7 | 1.7 | 0.6 | 0.0 | −0.8 | 1.9 |

wherein about 20 to about 50 domains are present in a 10 μm×10 μm square in the conductive layer.

2. The conductive member according to claim 1, wherein the conductive member has a volume resistivity of about 10.0 to about 12.5 log Ω·cm.

3. The conductive member according to claim 2, wherein the organic polymer material comprises a polar rubber.

4. The conductive member according to claim 3, wherein the conductivity-imparting agent comprises carbon black.

5. The conductive member according to claim 4, wherein the conductive member is an endless belt.

6. The conductive member according to claim 3, wherein the conductive member is an endless belt.

7. The conductive member according to claim 2, wherein the conductivity-imparting agent comprises carbon black.

8. The conductive member according to claim 7, wherein the conductive member is an endless belt.

9. The conductive member according to claim 2, wherein the conductive member is an endless belt.

10. The conductive member according to claim 1, wherein the organic polymer material comprises a polar rubber.

11. The conductive member according to claim 10, wherein the conductivity-imparting agent comprises carbon black.

12. The conductive member according to claim 11, wherein the conductive member is an endless belt.

13. The conductive member according to claim 10, wherein the conductive member is an endless belt.

14. The conductive member according to claim 1, wherein the conductivity-imparting agent comprises carbon black.

15. The conductive member according to claim 14, wherein the conductive member is an endless belt.

16. The conductive member according to claim 1, wherein the conductive member is an endless belt.

17. A transfer unit for an image-forming apparatus, comprising:

a transfer belt comprising the conductive member according to claim 16; and a plurality of rollers that support and maintain the transfer belt in tension.

18. The transfer unit according to claim 17, wherein the transfer belt is a recording medium transport/transfer belt that transports a recording medium in a transfer area where a toner image is transferred to the recording medium.

19. An image-forming apparatus comprising:

an image carrier having a surface;

a charging unit that charges the surface of the image carrier;

an electrostatic-latent-image forming unit that forms an electrostatic latent image on the surface of the image carrier;

a developing unit that develops the electrostatic latent image on the surface of the image carrier with a developer comprising a toner to form a toner image;

a transfer unit that comprises a transfer belt comprising the conductive member according to claim 9 and that transfers the toner image from the surface of the image carrier to a recording medium; and a fixing unit that fixes the toner image to the recording medium.

20. The image-forming apparatus according to claim 19, wherein the transfer belt is a recording medium transport/transfer belt that transports the recording medium in a transfer area where the toner image is transferred to the recording medium.

* * * * *